US007146682B2

(12) United States Patent
Damman et al.

(10) Patent No.: US 7,146,682 B2
(45) Date of Patent: Dec. 12, 2006

(54) POWERED EDGE CLEANER

(75) Inventors: Charles H. Damman, Stow, OH (US); Mark A. Stransky, Munroe Falls, OH (US); Jackson W. Wegelin, Akron, OH (US)

(73) Assignee: The Hoover Company, North Canton, OH (US)

( * ) Notice: Subject to any disclaimer, the term of this patent is extended or adjusted under 35 U.S.C. 154(b) by 493 days.

(21) Appl. No.: 10/355,482

(22) Filed: Jan. 31, 2003

(65) Prior Publication Data

US 2004/0148731 A1 Aug. 5, 2004

(51) Int. Cl.
*A47L 9/04* (2006.01)

(52) U.S. Cl. ..... 15/388; 15/385; 15/362; 15/42; 134/21

(58) Field of Classification Search ..... 15/388, 15/385, 383, 363, 362, 42, 49.1, 27, 43, 375, 15/421
See application file for complete search history.

(56) References Cited

U.S. PATENT DOCUMENTS

| | | | | | |
|---|---|---|---|---|---|
| 601,628 | A * | 4/1898 | Browne | 15/42 |
| 604,783 | A * | 5/1898 | Parbel et al. | 15/42 |
| 801,882 | A * | 10/1905 | Knell | 15/42 |
| 865,084 | A * | 9/1907 | Deitch et al. | 15/42 |
| 866,640 | A * | 9/1907 | Friedman | 15/42 |
| 1,209,722 | A * | 12/1916 | Kirby | 15/387 |
| 1,218,134 | A * | 3/1917 | Tyler | 15/389 |
| 1,323,925 | A * | 12/1919 | Stewart | 15/375 |
| 1,559,105 | A * | 10/1925 | Johnson | 15/342 |
| 1,611,684 | A * | 12/1926 | Serva | 15/388 |
| 2,834,034 | A * | 5/1958 | Angell | 15/79.2 |
| 3,409,933 | A * | 11/1968 | Larsson | 15/364 |
| 3,460,188 | A * | 8/1969 | Boyd | 15/364 |
| 3,748,679 | A | 7/1973 | Rosendall | |
| 3,937,174 | A * | 2/1976 | Haaga | 15/42 |
| 3,978,539 | A * | 9/1976 | Yonkers | 15/42 |
| 4,099,284 | A * | 7/1978 | Shinozaki et al. | 15/42 |
| 4,198,727 | A | 4/1980 | Farmer | 15/396 |
| 4,499,628 | A * | 2/1985 | Platt | 15/421 |
| 4,854,006 | A * | 8/1989 | Nishimura et al. | 15/375 |
| 5,249,331 | A * | 10/1993 | Mitani et al. | 15/375 |
| 5,394,588 | A | 3/1995 | Kweon et al. | 15/372 |
| 5,903,955 | A | 5/1999 | Farone et al. | 15/331 |
| 6,421,874 | B1 | 7/2002 | McCormick | 15/364 |
| 2002/0092125 | A1 | 7/2002 | Vystrcil et al. | 15/416 |
| 2004/0221406 | A1 * | 11/2004 | Grey | 15/42 |
| 2005/0155169 | A1 * | 7/2005 | Cheah et al. | 15/42 |

FOREIGN PATENT DOCUMENTS

| | | |
|---|---|---|
| DE | 29918769 | 12/1999 |

(Continued)

*Primary Examiner*—Theresa T. Snider
(74) *Attorney, Agent, or Firm*—A. Burgess Lowe, Esq.; Michael J. Corrigan, Esq.

(57) ABSTRACT

A floor care appliance such as a vacuum cleaner is provided having a traction wheel powered edge cleaner comprised of a vertical axis rotary agitator which is affixed to either the right or left side of the suction nozzle. The agitator is rotated by the traction wheel when the vacuum cleaner is disposed along a wall surface and moved relative to the wall surface. The rotating action of the agitator sweeps dirt particles off of the wall surface and along the edge of the wall surface into the path of the suction nozzle for pickup. When not in use the edge cleaner is stored in the accessory storage rack like other accessory tools. The agitator can have differing agitator elements such as bristles or a fluff wheel.

27 Claims, 10 Drawing Sheets

FOREIGN PATENT DOCUMENTS

| | | | |
|---|---|---|---|
| DE | 29918769 | U1 | 12/1999 |
| GB | 1 547 285 | | 6/1979 |
| GB | 1 557 091 | | 12/1979 |
| GB | 2 213 047 | A | 9/1989 |
| JP | 07047046 | A | 2/1995 |
| WO | WO 98/48686 | | 11/1998 |

* cited by examiner

POWERED EDGE CLEANER

BACKGROUND OF THE INVENTION

1. Field of the Invention

This invention relates to an edge cleaner for a vacuum cleaner and, more specifically, to an edge cleaner for a vacuum cleaner that is powered by a friction wheel that engages the wall surface adjacent the edge to be cleaned for sweeping dirt particles into the path of the suction nozzle for pickup and removal.

2. Summary of the Prior Art

Upright vacuum cleaners are well known in the art. Typically, these upright vacuum cleaners include a vacuum cleaner housing pivotally mounted to a vacuum cleaner foot. The foot is formed with a nozzle opening and may include an agitator mounted therein for loosening dirt and debris from a floor surface. A motor may be mounted to either the foot or the housing for producing suction at the nozzle opening. The suction at the nozzle opening picks up the loosened dirt and debris and produces a stream of dirt-laden air which is ducted to the vacuum cleaner housing.

It is known to provide vacuum cleaners with an edge cleaning capability. For example, in U.S. Pat. No. 4,198,727 a vacuum cleaner is provided with holding devices on the sidewalls of its housing on which brushes can be mounted which enable baseboards in a room to be dusted while the vacuum cleaner is being moved about to clean the carpet.

In U.S. Pat. No. 5,394,588 a nozzle head is provided for a vacuum cleaner employing a roller-shaped duster that can be rotated and removed in order to improve efficiency of duster-cleaning. The nozzle head comprises outer and inner casings spaced from each other, a duster supporting shaft detachably and rotatably mounted in the inner casing, a roller-shaped duster member inserted on the duster supporting shaft, a duster holding member which has means for holding the duster supporting shaft and is slidably mounted in the inner casing, means for locking the duster holding member which is fixed to the inner casing, and means for stopping the duster supporting shaft which is disposed between the duster holding member and the opposite ends of the duster supporting shaft.

In U.S. Pat. No. 5,903,955 an upright vacuum cleaner is provided and includes an upper section with a handle 15 and a lower cleaning nozzle section 14, 14' having a main suction opening 18 formed in the underside 16 thereof. A suction source M is provided and an edge cleaning tool 60 having a suction bore 64 formed therethrough is releasably connected to the cleaning nozzle section 14'. A suction hose 20 selectively connects one of the main suction opening 18 of the nozzle 14' and the suction bore 64 of the edge cleaning tool 60 with the suction source M. First and second laterally spaced casters 30*a*, 30*b* extend from the underside 16 of the nozzle 14, 14' and each caster 30*a*, 30*b* is pivotable respectively about a vertical axis D,E. First and second laterally spaced fixed wheels 32*a*, 32*b*, each rotatable about a single rolling axis C, are also provided and positioned forward of the first and second casters 30*a*, 30*b*. Each fixed wheel 32*a*,32*b* includes a rolling surface 40*a*, 40*b* and curved inner and outer transition surfaces 42*a*, 42*b*, 44*a*, 44*b* connecting its rolling surface 40*a*, 40*b* to the inner and outer sides 42*a*, 42*b*, 44*a*, 44*b* of the wheel 32*a*, 32*b*.

In U.S. Pat. No. 6,421,874 a vacuum cleaner includes a housing having a handle pivotally mounted to a nozzle assembly. An agitator is received in an agitator cavity formed in the nozzle assembly. A suction fan and suction fan drive motor are carried on the housing. An edge cleaning brush is pivotally mounted to the nozzle assembly along a lateral edge of the nozzle assembly adjacent the agitator cavity. The brush includes a body having a series of apertures for receiving cleaning bristles and a pair of opposed mounting lugs. The edge cleaning brush is received in a recess with the mounting lugs held in a pair of opposed mounting openings in the nozzle assembly.

However, no patents were found in the prior art for an edge cleaning brush that is removable and has a powered agitator for sweeping debris into the path of the suction nozzle. The edge cleaning brushes of the prior art have an agitator that is fixed and only agitates when the structure it is affixed to moves relative to the surface being cleaned. These edge cleaning brushes have limited effectiveness because there is only a single cleaning stroke which is limited in one direction. The edge cleaner of the present invention has a rotary agitator which rotates relative to the structure or suction nozzle it is mounted on and provides numerous cleaning strokes not only in the direction of travel of the suction nozzle but in all directions as the agitator rotates. Therefore, the present invention fulfills a need not found in the prior art.

Accordingly, it is an object of the invention to provide an improved edge cleaner for a floor care appliance.

It is a further object of this invention to provide an improved edge cleaner for a floor care appliance which includes a rotary agitator.

It is yet a further object of this invention to provide an improved edge cleaner for a floor care appliance which includes a rotary agitator that is powered by a traction wheel.

It is yet still a further object of this invention to provide an improved edge cleaner for a floor care appliance which is removable.

It is a further object of this invention to provide an improved edge cleaner for a floor care appliance which can be mounted on either side of the suction nozzle.

It is yet a further object of this invention to provide an improved edge cleaner for a floor care appliance which has a suction conduit formed therethrough fluidly connected to the interior of the suction nozzle.

It is yet still a further object of this invention to provide an improved floor care appliance which has one or more suction openings formed on the periphery of the suction nozzle proximate to a point of attachment of the edge cleaner.

It is a further object of this invention to provide an improved floor care appliance which has one or more suction openings containing an agitation elements(s) wherein the suction openings are formed on the periphery of the suction nozzle proximate to a point of attachment of the edge cleaner.

It is yet further an object of this invention to provide an improved floor care appliance which has one or more suction openings formed on the periphery of the suction nozzle proximate to a point of attachment of the edge cleaner wherein the suction opening has a gate which is opened when the edge cleaning brush is attached to the suction nozzle and closed when the edge cleaner is removed from the suction nozzle.

SUMMARY OF THE INVENTION

The invention is an edge cleaner for a floor care cleaner including an upright vacuum cleaner, canisters, robots, stick cleaners, extractors, and bare floor cleaners. The edge cleaner is removably attached to either the right or left edges of the cleaner's suction nozzle or main body when in use.

When not in use, the edge cleaner is stored like most off-the-floor accessories in the vacuum cleaner accessory rack, or if pivotally mounted, pivoted into the non-use position. The edge cleaner is comprised of a mounting bracket for holding a vertical axis rotary agitator. The vertical axis rotary agitator is powered by a traction wheel which contacts the wall surface adjacent the edge of the floor to be cleaned. The agitator brushes dirt along the edge of the wall surface directly into the path of the suction nozzle.

In a first alternate embodiment of the present invention, a suction opening is formed in the suction nozzle in the vicinity of the edge cleaner to pull dirt particles into the suction nozzle that are swept into the path of the suction nozzle. The suction opening is formed on both the left and right edges of the suction nozzle so that there is a suction opening available when the edge cleaner is installed on either the right or left edge of the suction nozzle.

In a second alternate embodiment of the invention, a suction opening is formed on both the right and left front edge of the suction nozzle so that there is a suction opening available when the edge cleaner is installed on the front edge of either the right or left hand side of the suction nozzle.

In a third alternate embodiment of the invention, a traction wheel powered edge cleaner is comprised of a friction wheel which drives a rotary agitator via a flexible belt.

In a fourth embodiment of the invention, a traction wheel powered edge cleaner is mounted on either of the right or left edges of a suction nozzle in addition to an agitator which is mounted directly beneath each of the right and left edges of the suction nozzle. The agitator is comprised of a plurality of bristles that sweep dirt from underneath the right and left edges of the suction nozzle that is otherwise out of the reach of the main agitators or the traction wheel powered edge cleaner.

In a fifth embodiment of the invention, a gate is provided for each of the suction openings on the right of the left edges of the suction nozzle which is normally biased into a closed position when the edge cleaner is not installed. A gate opening member from the edge cleaner is inserted into the suction opening to move the gate into the open position when the edge cleaner is installed. When the edge cleaner is removed, the gate returns to normally closed position.

In a sixth embodiment of the invention, a gate is provided for each of the suction openings formed on the right and left hand sides on the front edge of suction nozzle 100. A gate opening member from the edge cleaner is inserted into the suction opening to move the gate into the open position when the edge cleaner is installed. When the edge cleaner is removed, the gate returns to normally closed position.

In a seventh alternate embodiment of the invention, a suction is formed through the interior of the arm mounting the edge cleaner to the suction nozzle and the rotary agitator itself. The suction bores create a suction path from the suction nozzle to the exterior of the rotary agitator so that dirt particles may be removed in the vicinity of the rotary agitator.

BRIEF DESCRIPTION OF THE DRAWINGS

Reference may now be had to the accompanying drawings for a better understanding of the invention, both as to its organization and function, with the illustration being only exemplary and in which.

Figure 1:
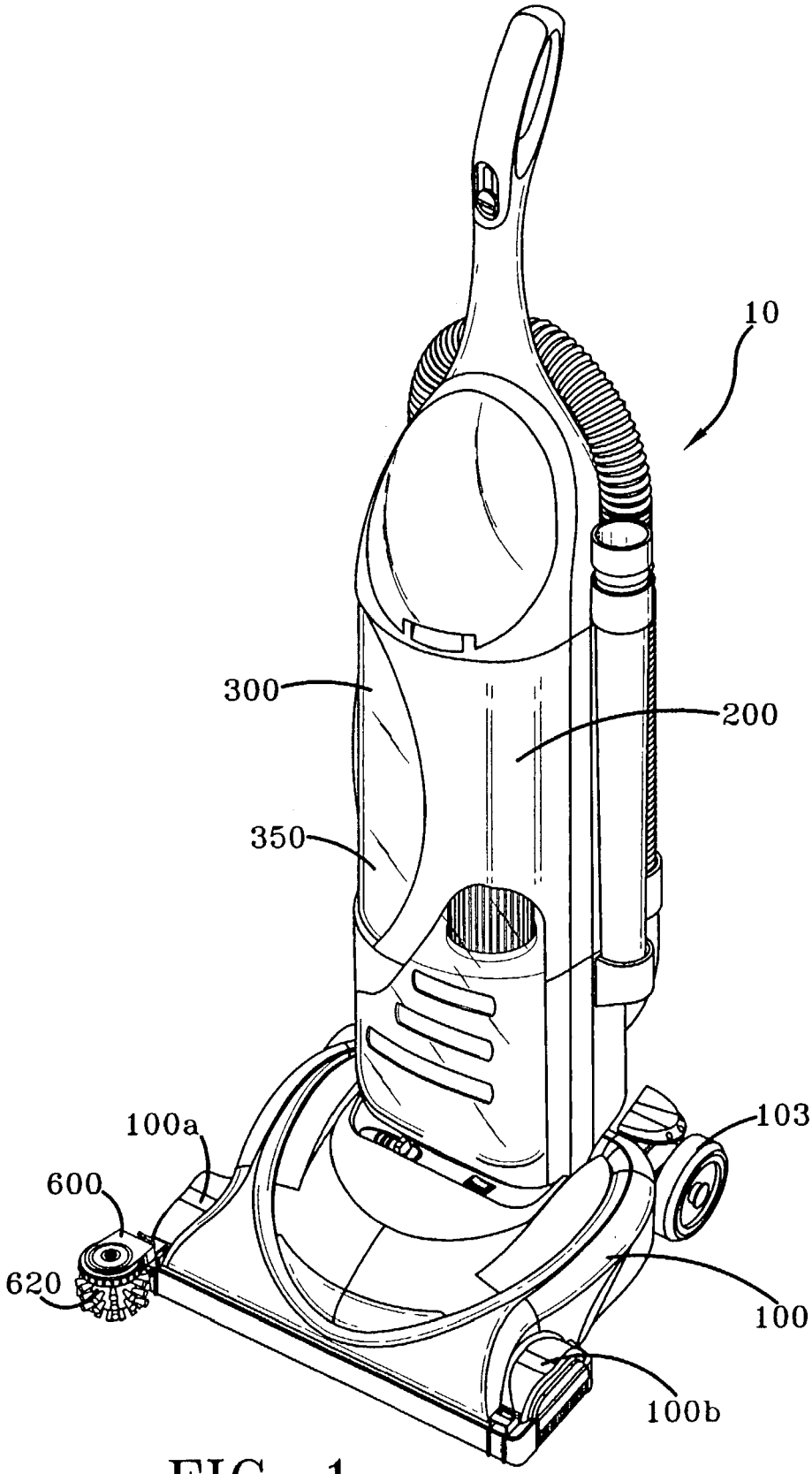
FIG. 1 is a perspective view of an upright vacuum cleaner having a traction wheel powered edge cleaner attached to the right hand side of the suction nozzle, according to the preferred embodiment of the invention.
Figure 9:
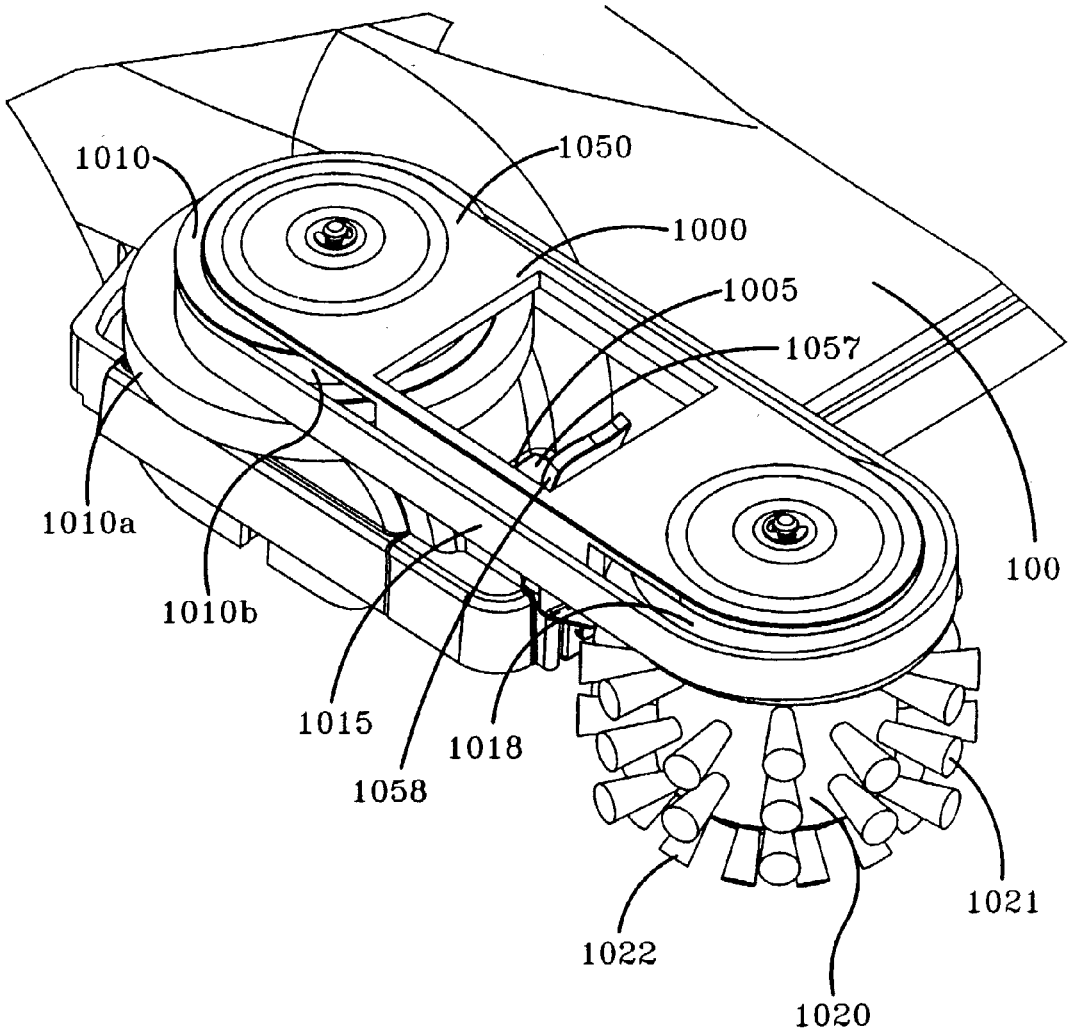
Figure 10:
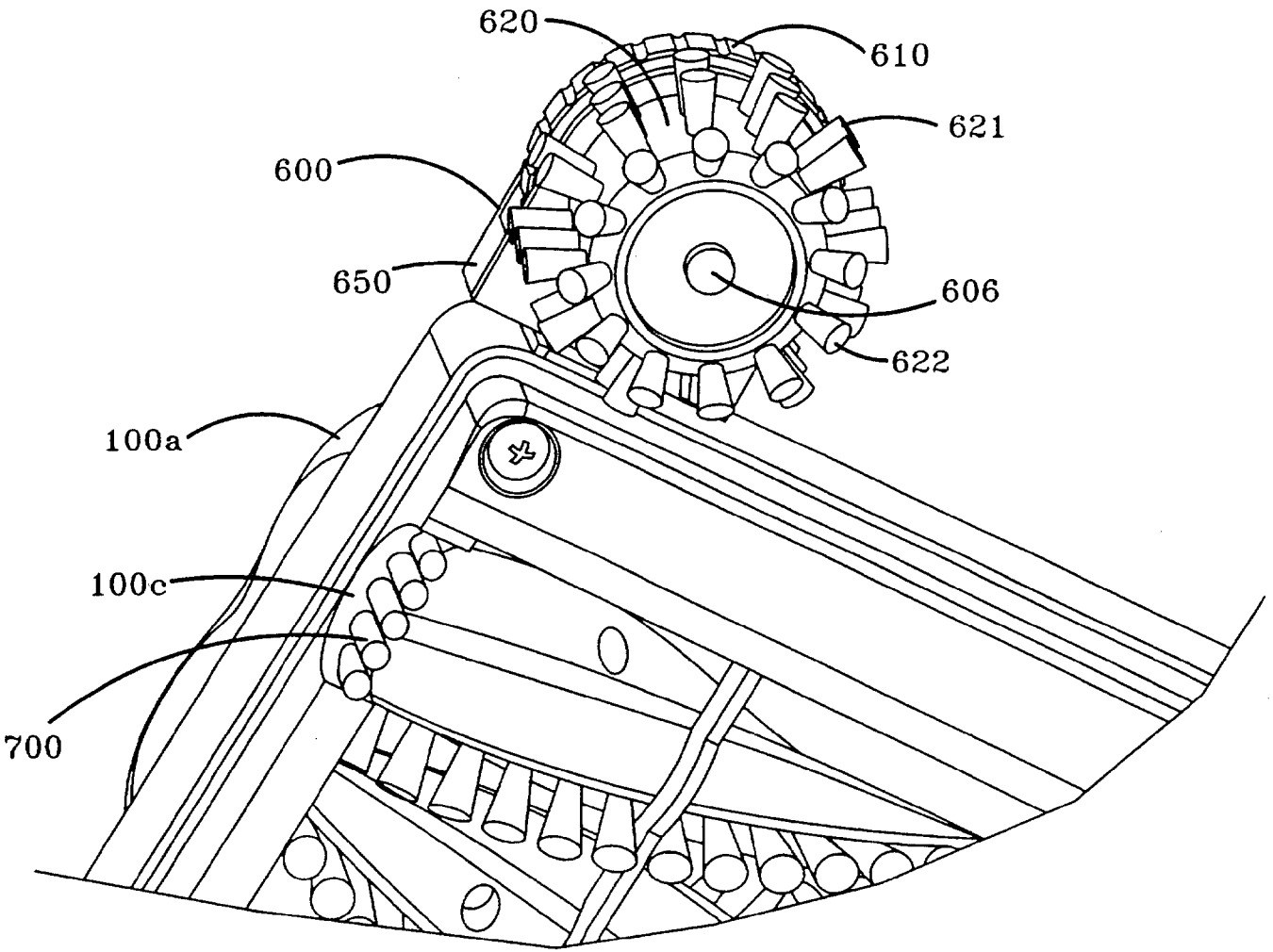
Figure 11:
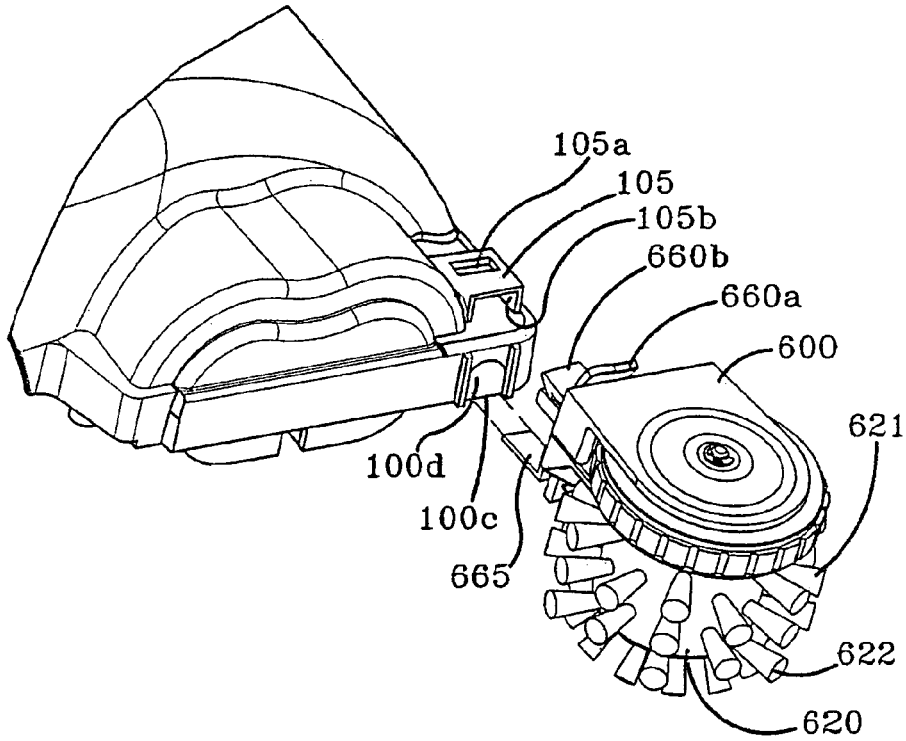
Figure 12:
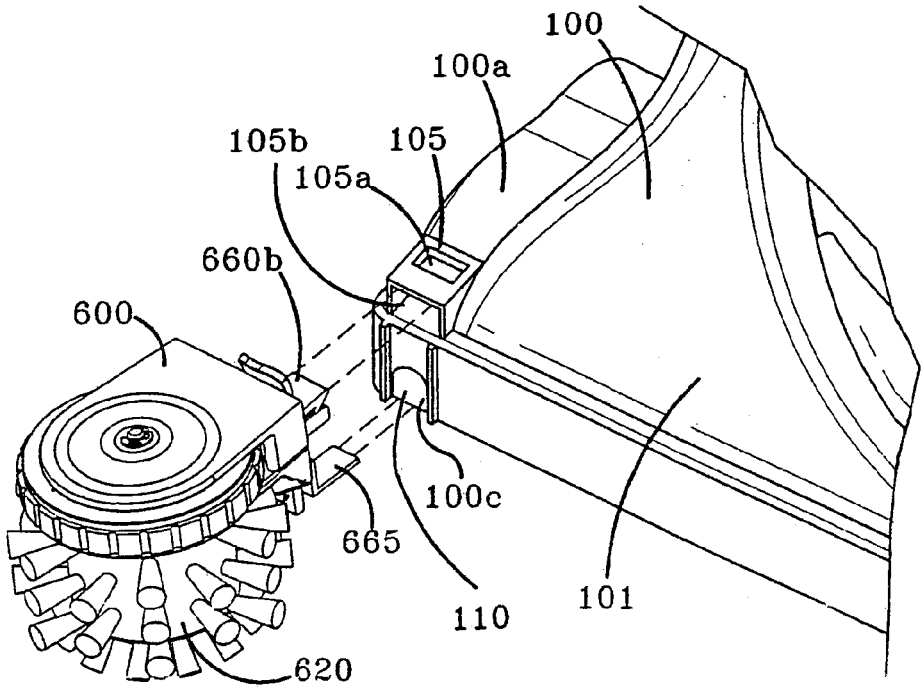
Figure 13:
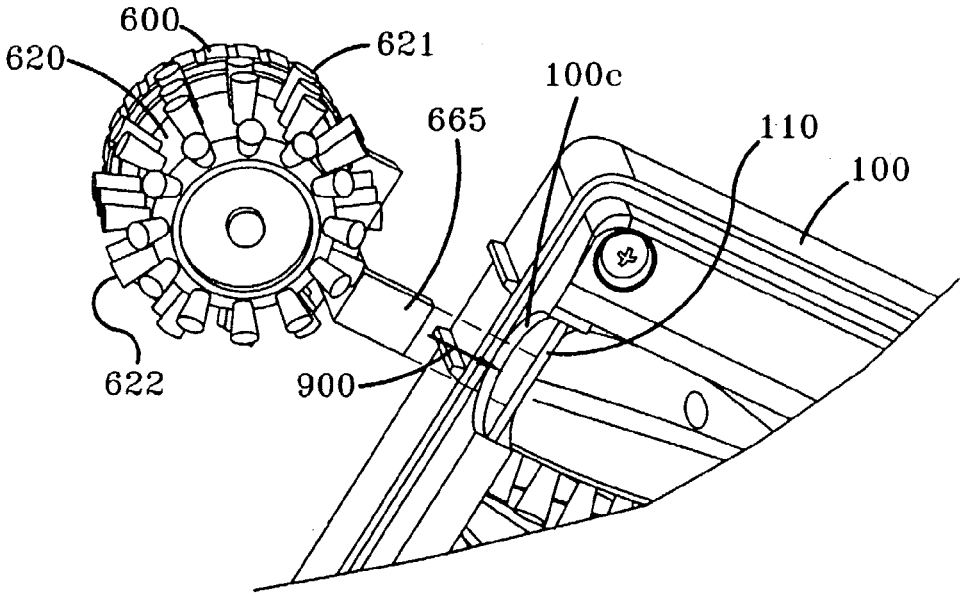
Figure 14:
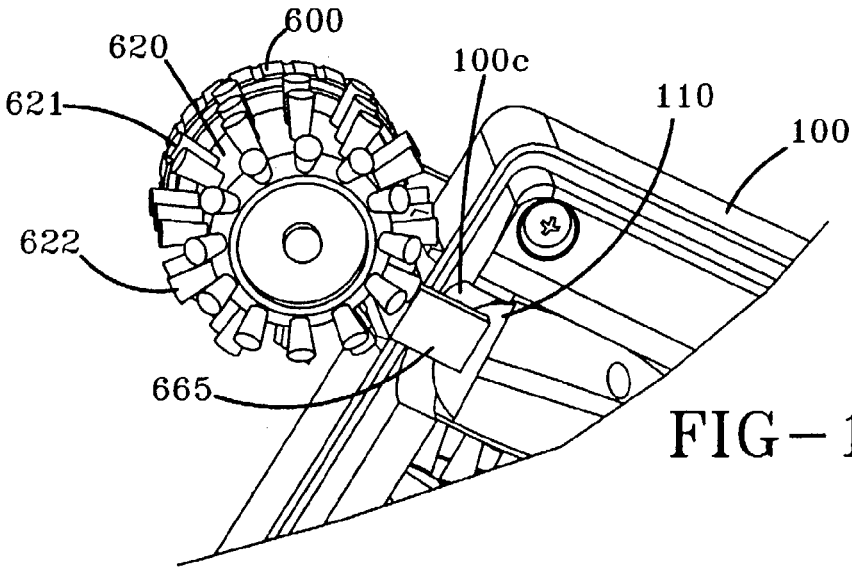
Figure 15:
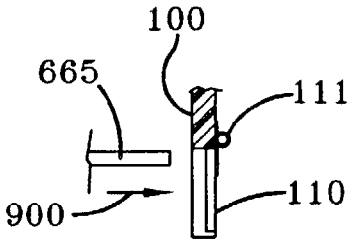
Figure 16:
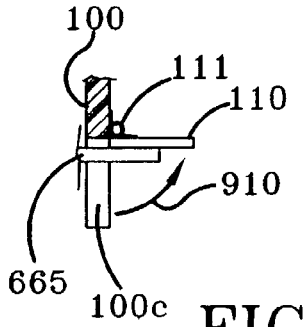

FIG. **8*a* is a slightly elevated rear perspective view of the traction wheel powered edge cleaner attached to the right hand side of the suction nozzle of the upright vacuum cleaner shown in FIG. 1** and a suction opening formed in the right edge of the suction nozzle, according to a first alternate embodiment of the invention;

FIG. **8*b* is a slightly elevated rear perspective view of the traction wheel powered edge cleaner attached to the right hand side of the suction nozzle of the upright vacuum cleaner shown in FIG. 1** and a suction opening formed in the front edge of the right hand side of the suction nozzle, according to a second alternate embodiment of the invention;

FIG. 9 is slightly elevated perspective view of a traction wheel powered edge cleaner attached to a partially cutaway portion of a vacuum cleaner suction nozzle from an upright vacuum cleaner like the one shown in FIG. 1, according to a third alternate embodiment of the present invention;

FIG. 10 is slightly elevated perspective view of a traction wheel powered edge cleaner attached to a partially cutaway portion of a vacuum cleaner suction nozzle from an upright vacuum cleaner like the one shown in FIG. 1 and an agitator brush embedded on the edge of the suction nozzle, according to a fourth alternate embodiment of the present invention;

FIG. 11 is a slightly elevated side perspective view of the traction wheel powered edge cleaner detached from a cutaway portion of the right hand side of the suction nozzle of the upright vacuum cleaner shown in FIG. 1 wherein the suction nozzle has a suction port along the right edge with a gate normally biased in the closed position and a gate opening member positioned on the traction wheel powered edge cleaner for holding the gate in the open position when the traction wheel powered edge cleaner is installed on the suction nozzle, according to a fifth alternate embodiment of the invention;

FIG. 12 is a slightly elevated front perspective view of the traction wheel powered edge cleaner detached from a cutaway portion of the right hand side of the suction nozzle of the upright vacuum cleaner shown in FIG. 1 wherein the suction nozzle has a suction port along the front edge with a gate normally biased in the closed position and a gate opening member positioned on the traction wheel powered edge cleaner for holding the gate in the open position when the traction wheel powered edge cleaner is installed on the suction nozzle, according to a sixth alternate embodiment of the invention;

FIG. 13 is a slightly elevated bottom perspective view of the traction wheel powered edge cleaner detached from a cutaway portion of the right hand side of the suction nozzle of the upright vacuum cleaner shown in FIG. 11 showing the intended operation of the gate opening member positioned on the traction wheel powered edge cleaner for holding the gate in the open position when the traction wheel powered edge cleaner is installed on the suction nozzle, according to the fifth alternate embodiment of the invention;

FIG. 14 is a slightly elevated bottom perspective view of the traction wheel powered edge cleaner attached to a cutaway portion of the right hand side of the suction nozzle of the upright vacuum cleaner previously shown in FIG. 11 showing the operation of the gate opening member positioned on the traction wheel powered edge cleaner holding the gate in the open position when the traction wheel powered edge cleaner is installed on the suction nozzle, according to the fifth alternate embodiment of the invention;

FIG. 15 is a partially cutaway side view of the gate opening member positioned on the traction wheel powered edge cleaner showing the intended operation of the gate opening member on the gate of the suction portion on the edge of a partially cutaway portion of the suction nozzle of the upright vacuum cleaner shown in FIG. 1, according to the fifth and sixth embodiments of the invention; and FIG. 16 is a partially cutaway side view of the gate opening member positioned on the traction wheel powered edge cleaner showing the operation of the gate opening member on the gate of the suction portion on the edge of a partially cutaway portion of the suction nozzle of the upright vacuum cleaner shown in FIG. 1, according to the fifth and sixth alternate embodiments of the invention.

DETAILED DESCRIPTION OF THE INVENTION

A vacuum cleaner incorporating one embodiment of a traction wheel powered edge cleaner is shown in FIG. 1 and is indicated generally at 10. Upright vacuum cleaner 10 includes a foot or suction nozzle 100 and an upper housing assembly 200 pivotally connected to suction nozzle 100. During vacuuming operations, the suction nozzle 100 travels across the floor, carpet, or other sub-adjacent surface being cleaned, with its underside being in proximity therewith. Suction nozzle 100 is similar to those known in the art and includes a nozzle opening (not shown) through which dirt, dust, and other debris on the surface being cleaned are suctioned into the vacuum cleaner. An agitator (not shown) is positioned within nozzle opening (not shown) for agitating and loosening dirt, dust and debris from a floor surface. A pair of rear wheels 103 are rotatably mounted on the bottom of suction nozzle 100 for moving upright vacuum cleaner 10 across the floor surface. A motor-fan assembly (not shown) is located in either suction nozzle 100 or housing 200 which creates the suction necessary to remove the loosened dirt, dust and debris from the floor surface. The motor-fan assembly (not shown ) is fluidly connected to the nozzle opening (not shown) and a filtration arrangement located in the upper housing assembly 200. In the preferred embodiment of the invention, the filtration arrangement is a dirt collecting system 300 which receives and filters the dirt-laden air stream which is created by the motor-fan assembly (not shown). Dirt collecting system 300 includes a dirt container 350 and one or more particle filtration media and is disclosed more fully in U.S. patent application Ser. No. 10/142,316, owned by a common assignee, and incorporated by reference more fully herein.

Figure 2:
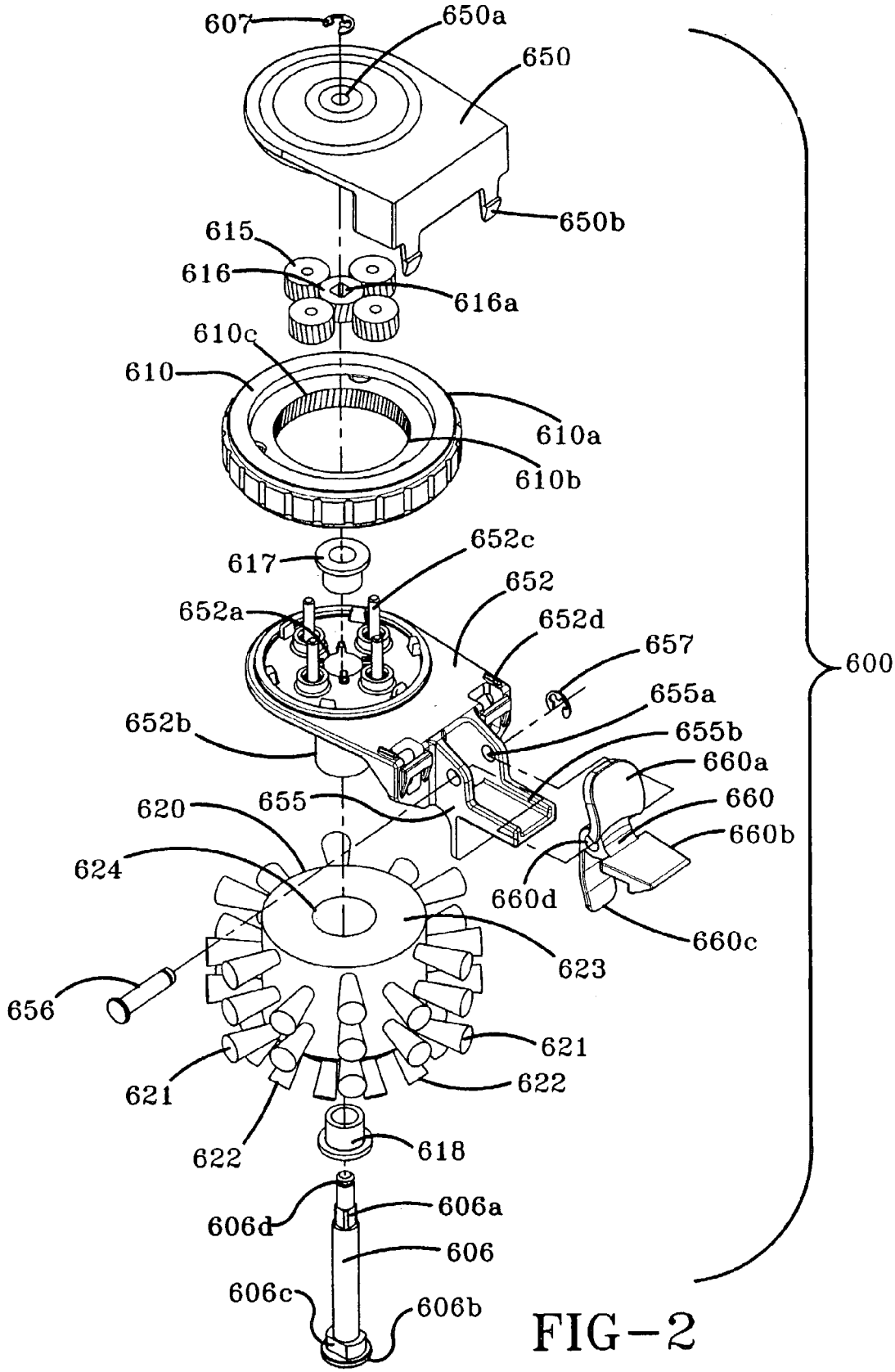
FIG. 2 is an exploded perspective view of a traction wheel powered edge cleaner, according to the preferred embodiment of the present invention.

In the preferred embodiment of the invention, attached to suction nozzle 100 is a traction wheel powered edge cleaner 600. Referring now to FIG. 2, traction wheel powered edge cleaner 600 is comprised of a vertical axis rotary agitator 620 which is affixed to either the right side 100*a* or left side 100*b* of the suction nozzle 100 (FIG. 1). The agitator 620 is rotated by a traction wheel 610 when the vacuum cleaner 10 is disposed along a wall surface 800 (FIGS. 5 and 6) and moved relative to the wall surface 800. The rotating action of the agitator 620 sweeps dirt particles off of the wall surface 800 and along the edge 851 of the wall surface 800 into the path of the suction nozzle 100 for pickup. Alternately, traction wheel 610 may be rotated when the vacuum cleaner 10 is disposed along a wall surface 800 having a base board 805 in a similar manner. When not in use the edge cleaner 600 is stored in the accessory storage rack (not shown) like other accessory tools (not shown). The agitator 620 can have differing agitator elements such as bristles 621 and 622, a fluff wheel (not shown) comprised of a soft, non-abrasive material or other agitator materials including lambs wool, felt and feathers.

Edge cleaner 600 further includes a spindle 606 which agitator 620 rotates about and a clip 607 holding agitator 620 thereon. A clip 607 snap fits into a groove 606*d* cut into the upper end of spindle 606. A bushing 617 and 618 may also be used for aligning the spindle 606 in main body member 652. Spindle 606 passes through a bore 652*a* formed in a downwardly projecting boss 652*b* formed in the main body member 652 for holding agitator 620 in a downwardly disposed fashion. The lower end of spindle 606 has a mushroom shaped head 606*b* for holding agitator 620 on spindle 606. Main body member 652 is affixed to the upper surface of suction nozzle 100 extending therefrom in a cantilever fashion so that edge cleaner 600 may be disposed adjacent the wall surface 800 (FIGS. 5 and 6) or as otherwise described. The traction wheel 610 is disposed between the main body member 652 and cover 650 wherein spindle 606 passes through an aperture 650*a* formed in cover 650. Cover 650 attaches to main body member 652 via a pair of downwardly projecting prongs 650*b* which are received by a pair of complementary recesses 652*a* in a snap fit arrangement. A plurality of spacer members 652*c* project upwardly from main body member 652 to uniformly space cover 650 from main body member 652. Disposed on the interior circumference 610*b* of traction wheel 610 are a plurality of gear teeth 610*c*. Gear teeth 610*c* are operatively connected to a plurality of planetary gears 615 which are operatively connected to single gear 616 which is centrally located. Gear 616 has a square bore 616*a* cut therethrough for receiving a complementary square shaped portion 606*a* on spindle 606 so that spindle 606 is rotated when traction wheel 610 is rotated. A double "D" shaped shank 606*c* on spindle 606 fits into a complementary recess (not shown) on the underside of agitator 620 to ensure that agitator 620 is rotated by spindle 606. Spindle 606 is non-rotatably coupled to agitator 620 so that agitator 620 is rotated when traction wheel 610 is rotated. A ring 610*a* circumscribes the outer periphery of traction wheel 610 which is made of a high friction, non-slip material to ensure that traction wheel 610 is rotated when contact is made with a wall surface 800 (FIGS. 5 and 6) as suction nozzle 100 is moved relative to the wall surface 800.

The use of the planetary gears 615 and gear 616 operatively connected to traction wheel 610 and spindle 606 changes the direction of rotation of agitator 620 as compared to the direction of rotation of traction wheel 610. Due to the differences in gear ratios between planetary gears 615 and gear 616, the torque transmitted to agitator 620 is reduced but the revolutions per minute of agitator 620 is increased which is more suitable for cleaning applications. The resultant motion of agitator 620 as compared to traction wheel 610 and the wall surface 800 is best demonstrated in FIGS. 5 and 6. In alternate embodiments of the invention, other means or transmission arrangements to couple agitator 620 to a rotary power source such as the traction wheel 610 could be used such as toothed gears, air turbine, motor, belts and pulleys, and worm and helical gears. Whatever transmission arrangement selected, the arrangement can be configured to rotate the agitator 620 in the same or opposite direction of the rotary power at a higher or lower speed than the rotary power source.

Figure 3:
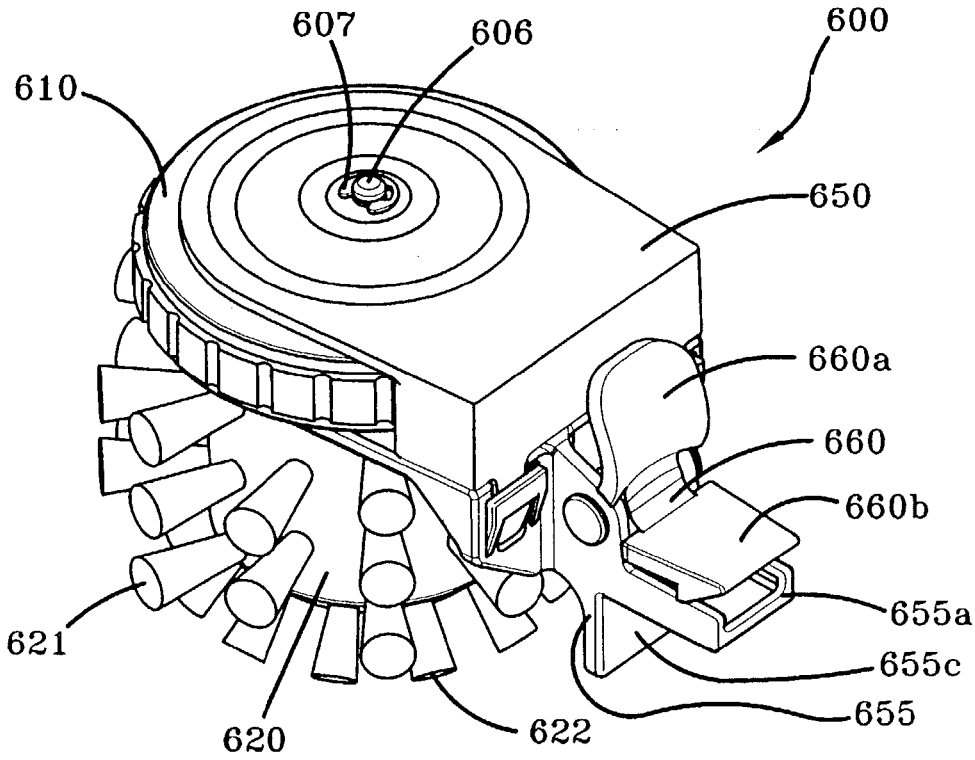
FIG. 3 is a slightly elevated rear perspective view of a traction wheel powered edge cleaner, according to the preferred embodiment of the present invention.
Figure 4:
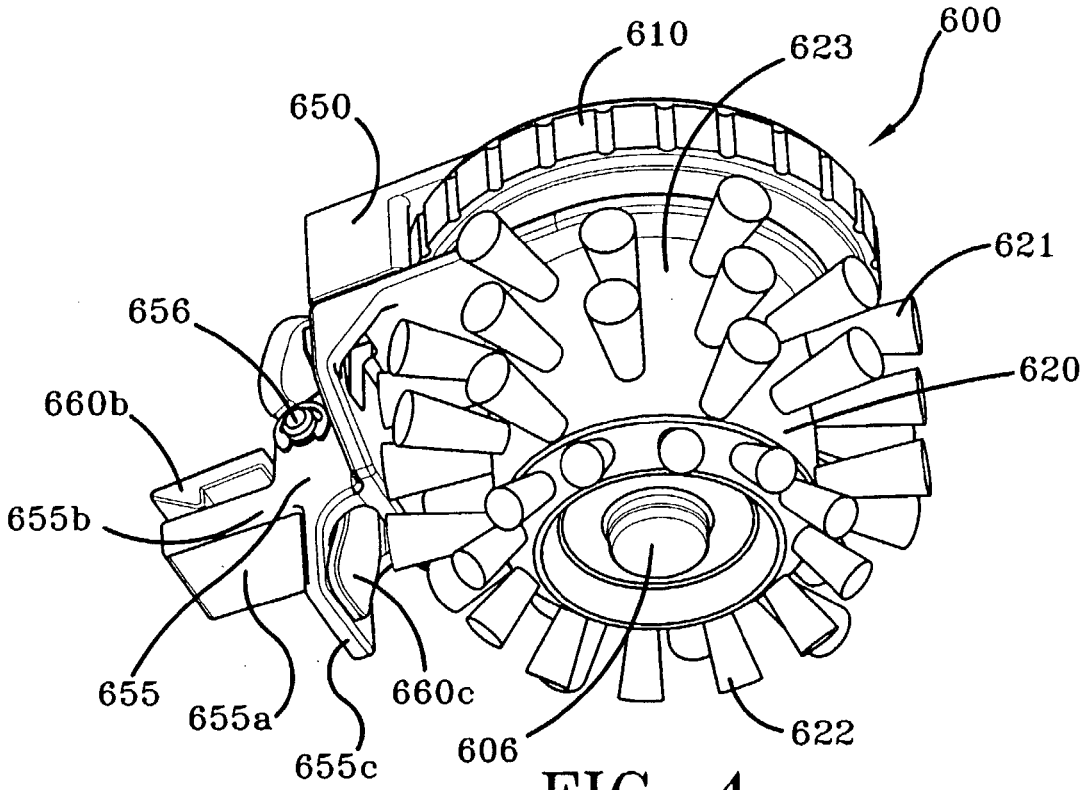
FIG. 4 is a slightly elevated front perspective view of a traction wheel powered edge cleaner, according to the preferred embodiment of the present invention.

Referring to FIG. 2 and FIGS. 3 and 4, agitator 620 includes an agitator spindle 623 having a bore 624 for allowing spindle 606 to pass therethrough. A first set of bristles 621 extend radially outward in a helical or other pattern from the outer surface of agitator spindle 623 for sweeping the wall 800 or baseboards 805 (FIGS. 5 and 6) located on wall surface 800, if so equipped. A second set of bristles 622 extend radially outward from the lower end of agitator spindle 623 being spaced evenly thereon for sweeping particles from the edge 851 (FIGS. 5 and 6) of wall surface 800 (FIGS. 5 and 6) into the path of suction nozzle 100. Bristles 621 and bristles 622 may be made from nylon or other suitable material. In an alternate embodiment of the invention, bristles 621 and bristles 622 may be replaced with a fluff wheel made from a soft, non-abrasive material such as lambs wool for dusting the wall surface 800 (FIGS. 5 and 6) and edge 810 (FIGS. 5 and 6).

Figure 5:
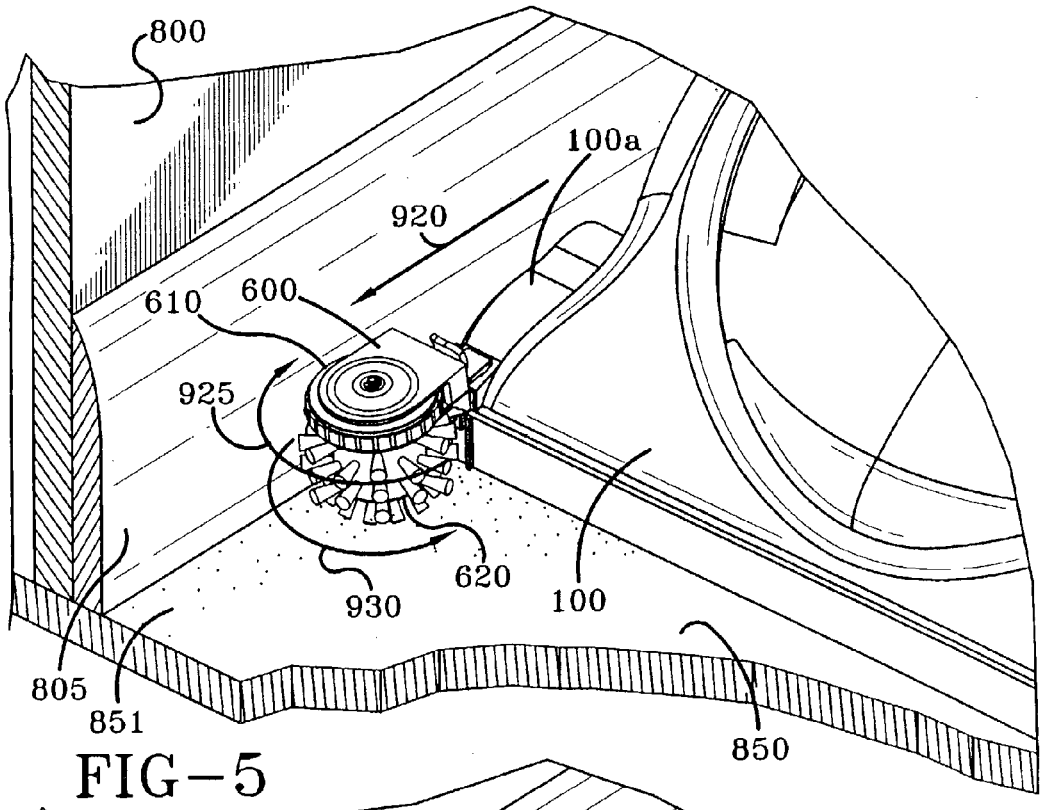
FIG. 5 is a partially cutaway perspective view of the upright vacuum cleaner shown in FIG. 1 showing the operation of the traction wheel powered edge cleaner on a portion of a wall and floor surface, according to the preferred embodiment of the invention.
Figure 6:
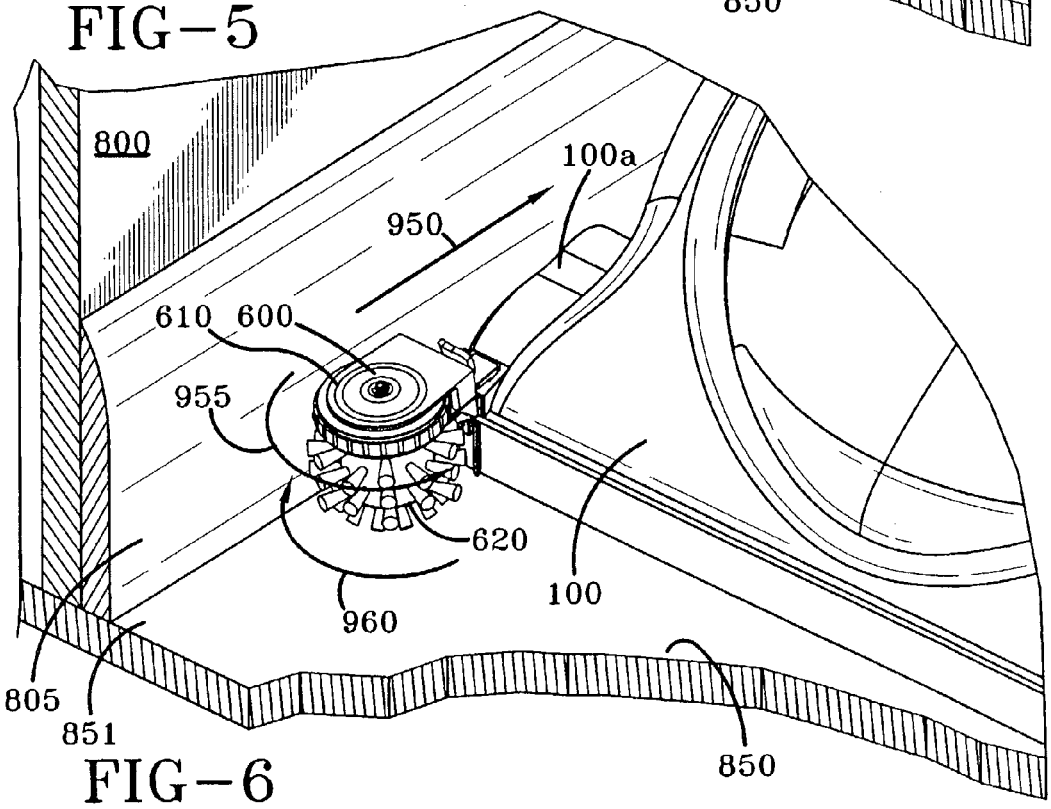
FIG. 6 shows the operation of the traction wheel powered edge cleaner in a direction opposite that shown in FIG. 5, according to the preferred embodiment of the invention.

Referring now to FIGS. 5 and 6, edge cleaner 600 is mounted on the right hand side 100*a* of suction nozzle 100. As most wall surfaces in rooms have a baseboard at the bottom edge, a baseboard 805 is included in FIGS. 5 and 6. Directly adjacent the baseboard 805 is the floor edge 851 of floor 850. Referring now specifically to FIG. 5, when suction nozzle 100 is moved in the direction of arrow 920, traction wheel 610 engages baseboard 805 and is rotated in the direction of arrow 925. Traction wheel 610 in turn rotates agitator 620 in the direction of arrow 930. Bristles 621 and bristles 622 will sweep dirt particles on baseboard 805 and floor surface 850 in the vicinity of edge 851 into the path of suction nozzle 100 where the suction from suction nozzle 100 will pick up the dirt particles for transport to the particle filtration and collecting system 300. Conversely, when suction nozzle 100 is moved in the direction of arrow 950 (FIG. 6), traction wheel 610 engages baseboard 805 and is rotated in the direction of arrow 955. Traction wheel 610 in turn rotates agitator 620 in the direction of arrow 960. Bristles 621 and bristles 622 sweep dirt particles on baseboard 805 and floor surface 850 in the vicinity of edge 851 that were missed in the prior movement of suction nozzle 100 in the direction of arrow 920 into the previous path of suction nozzle 100 so that when suction nozzle 100 is moved back over floor 850 in the direction of arrow 920 the dirt particles will be removed by the suction from suction nozzle 100 for transport to the particle filtration and collecting system 300.

Figure 7:
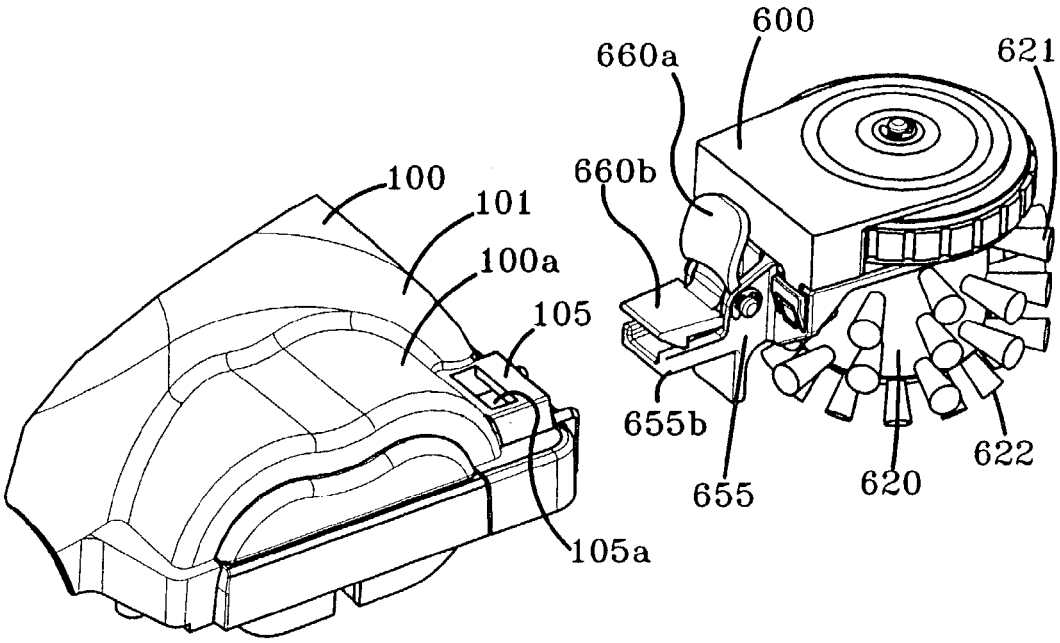
FIG. 7 is a slightly elevated rear perspective view of the traction wheel powered edge cleaner detached from the right hand side of the suction nozzle of the upright vacuum cleaner shown in FIG. 1, according to the preferred embodiment of the invention.
Figure 8:
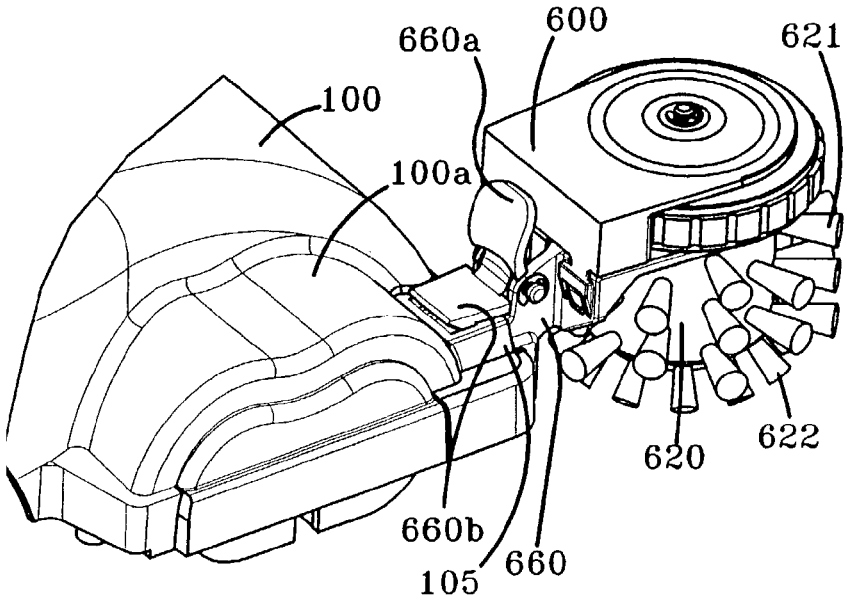
FIG. 8 is a slightly elevated rear perspective view of the traction wheel powered edge cleaner attached to the right hand side of the suction nozzle of the upright vacuum cleaner shown in FIG. 1, according to the preferred embodiment of the invention.

FIGS. 7 and 8 shows the details of the mounting of edge cleaner 600 on the upper surface of hood 101 on the right hand side 100*a* of suction nozzle 100. In the preferred embodiment of the invention, edge cleaner 600 is installed in the upper surface of hood 101 by a mounting member 655 having an outwardly extending tongue 655*b* (best seen in FIGS. 3 and 4) inserted into a socket 105*b* formed from a bracket 105 mounted on hood 101 (best seen in FIG. 8B). Mounting member 655 is attached to main body member 652. A spring biased clip 660 secures edge cleaner 600 to suction nozzle 100. Clip 660 has a latch arm 660*b* having a downwardly disposed ledge which engages a slot 105*a* in bracket 105 (FIG. 7) on suction nozzle 100. The ledge is biased downward into the slot 105*a* by a resilient tongue portion 660*c* (FIG. 2) that is biased against a downwardly projecting sidewall 655*c* (FIGS. 3 and 4) extending from mounting member 655. Clip 660 is pivotally attached to mounting member 655 by a pin 656 which fits through a pair of opposing apertures 655*a* in mounting member 655 and a bore 660*d* through clip 660. A retaining ring 657 slipped onto one end of pin 656 secures pin 656 to mounting member 655. In this manner, the biasing force of tongue portion 660*b* against sidewall 655*c* is pivotally transmitted to the latch arm 660*b* to secure edge cleaner 600 to suction nozzle 100. A thumb tab 660*a* also protruding from clip 660 allows the latch arm 660*b* to be lifted from slot 105*a* against the biasing force of tongue portion 660*c* to remove edge cleaner 600 from suction nozzle 100.

Figure 8A:
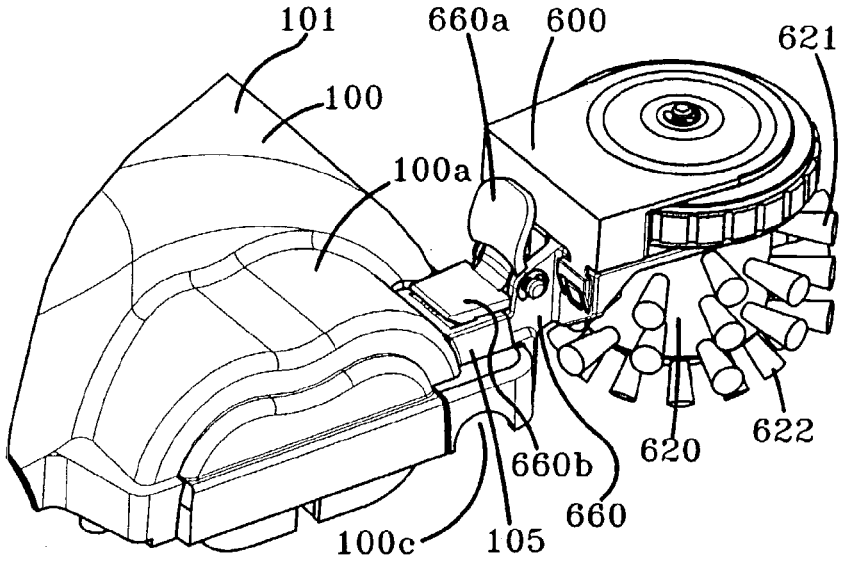
Figure 8B:
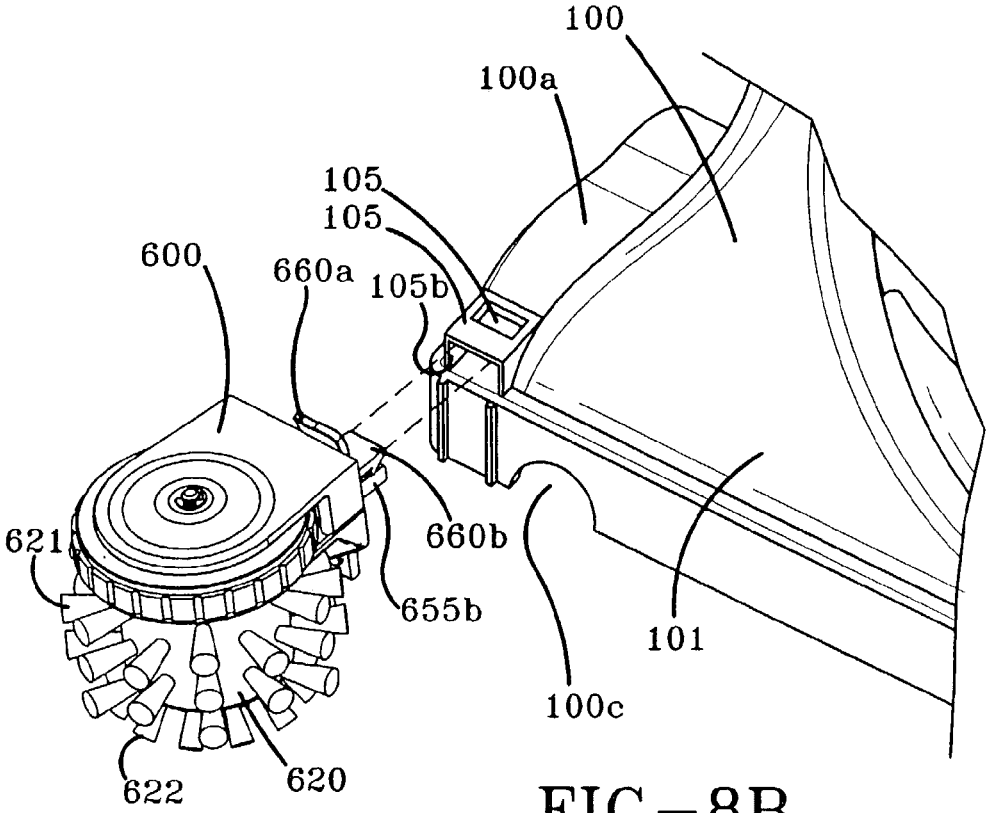

Referring now to FIGS. 8A and 8B, in a first alternate embodiment of the present invention, a suction opening 100*c* is formed in the suction nozzle 100 in the vicinity of the rotary edge cleaner 600 to pull dirt particles into the suction nozzle 100 that are swept into the path of the suction nozzle 100 by rotary edge cleaner 600. Suction opening 100*c* may be formed in one side of the suction nozzle 100, as depicted in FIG. 8A, or in a second alternate embodiment of the invention, suction opening 100*c* may be formed in the front edge of suction nozzle 100, as depicted in FIG. 8B.

Referring now to FIG. 9, shown is a third alternate embodiment of the invention wherein a traction wheel powered edge cleaner 1000 is shown mounted on a cutaway portion of a suction nozzle 100. Edge cleaner 1000 is comprised of a rotary agitator 1020 which includes a plurality of sidewardly extending bristles 1021 and a plurality of downwardly extending bristles 1022. Rotary agitator 1000 extends downwardly from a mounting member 1050 and is mounted in a rotatable fashion. A disc shaped member or friction wheel 1010 is also mounted in a downwardly disposed fashion from mounting member 1000 and is rotatable thereabout. Friction wheel 1010 has an outer periphery 1010*a* for contact with a wall surface such as that depicted in FIG. 5 or 6. Outer periphery 1010*a* may include one or more layers of a material known to have high friction characteristics. Located above friction wheel 1010 is a pulley 1010*b* which is non-rotatable with respect to friction wheel 1010. A flexible belt 1015 extends from pulley 1010*b* to a pulley 1018 located at the upper end of agitator 1020. Rotary power in friction wheel 1010 is developed when friction wheel 1010 contacts a wall surface 800 (FIGS. 5 and 6) when suction nozzle 100 is moved over a floor surface 850. The rotary power from friction wheel 1010 is transferred from pulley 1010*b* by belt 1015 to pulley 1018 at the top of agitator 1020 to rotate agitator 1020 to sweep dirt particles into the path of suction nozzle 100. Edge cleaner 1000 is mounted on one edge of a suction nozzle 100 in a manner similar to the preferred embodiment with a tongue member being inserted into a groove slot (not shown) on the suction nozzle 100 and being held thereby by a biased latch member 1057 engaging a slot 1005 also on the suction nozzle 100. A thumb tab 1058 is also provided to release the latch member 1057 from the slot 1005 so that the edge cleaner 1000 may be removed from suction nozzle 100. In other alternate embodiments of the invention (not shown) the rotary agitator 1000 could be rotated by a turbine including an air turbine driven by suction created by the suction motor (not shown), an independent motor, or a gear or belt drive powered by a rotary power source such as the main agitator drive motor. In a fourth embodiment of the invention, and referring to FIG. 10, in addition to the traction wheel powered edge cleaner 600 being mounted on one edge of the suction nozzle 100, an edge cleaner 700 may be mounted on one or more of the outer sides of the suction nozzle outward of the suction nozzle's main agitators. The edge cleaners(s) 700 sweeps dirt from underneath the outer edges of the suction nozzle that is otherwise out of the reach of the main agitators or the traction wheel powered edge cleaner 600. The edge cleaner(s) 700 is comprised of one or more bristles arranged in row and extending downwardly from the edge of the suction nozzle.

In a fifth embodiment of the invention, and referring now to FIGS. 11 and 13, suction opening 100*c* is closed off by a gate 110 when edge cleaner 600 is not installed on suction nozzle 100. Gate 110 is normally biased into the closed position as shown in FIG. 15. by a biasing means such as a spring member 111. A gate opening member 665 extending from edge cleaner 600 inserted into suction opening 100*c* in the direction of arrow 900 pushes gate 110 in the direction of arrow 910 to the open position as demonstrated in FIG. 16. Edge cleaner 600 is shown in the installed position on a cutaway portion of suction nozzle 100 in FIG. 14. Obviously, when edge cleaner 600 is removed spring 111 will cause gate 110 to return to the closed position.

In a sixth embodiment of the invention, and referring now to FIG. 12, suction opening 100*c* is formed on the front edge of suction nozzle 100. Edge cleaner 600 is mounted on the front edge and suction opening 100*c* is closed off by a gate 110 when edge cleaner 600 is not installed on suction nozzle 100. Like in the fifth embodiment of the invention, gate 110 is normally biased into the closed position as shown in FIG. 15. by a biasing means such as a spring member 111. A gate opening member 665 extending from edge cleaner 600 is inserted into suction opening 100*c* in the direction of arrow 900 (FIG. 15) pushes gate 110 in the direction of arrow 910 to the open position as demonstrated in FIG. 16. Obviously, when edge cleaner 600 is removed spring 111 will cause gate 110 to return to the closed position.

In a seventh alternate embodiment of the invention (not shown), suction bores (not shown) may pass through the interior of main body member 652 and agitator spindle 623, respectively. The suction bores (not shown) are fluidly connected to the suction cavity 106 of suction nozzle 100 to aid in removing particles from the floor surface.

In any of the aforesaid embodiments of the invention, edge cleaner 600 or edge cleaner 1000 can be stored in the accessory rack in a specially formed pocket or otherwise when not in use. Alternately, edge cleaner 600 could be pivotally mounted on suction nozzle 100 (not shown) and normally stowed in a non-operative position. When desired to be used, edge cleaner 600 is pivoted into the operative position and may be kept in the operative position with a latch or other mechanism.

It should be clear from the foregoing that the described structure clearly meets the objects of the invention set out in the description's beginning. It should now also be obvious that many changes could be made to the disclosed structure which would still fall within its spirit and purview.

The invention claimed is:

1. An edge cleaning device for a floor care appliance having a base moved over a floor surface to be cleaned, comprising:

an agitator body having an outer periphery and capable of rotation about an axis;

a plurality of radially extending bristles circumscribing the outer periphery of said agitator body; and a traction wheel coupled to the agitator body for rotating the agitator body about said axis;

wherein said edge cleaning device is attached to an exterior of said base of said floor care appliance and said traction wheel is rotated by engaging a wall surface adjacent a floor edge to be cleaned when said floor care appliance is moved past said wall surface.

2. The edge cleaning device of claim 1, further including a mounting member for mounting said edge cleaning device on the exterior periphery of said base.

3. The edge cleaning device of claim 2, wherein said mounting member includes a latch member for securing said mounting member to said outer periphery of said base.

4. The edge cleaning device of claim 3, wherein said base includes a receiving socket for receiving said mounting member.

5. The edge cleaning device of claim 4, wherein said latch member is biased in the latched position when said mounting member is received by said receiving socket.

6. The edge cleaning device of claim 1, wherein said base is a suction nozzle.

7. The edge cleaning device of claim 1, wherein said axis is vertical.

8. A floor care appliance, comprised of:

a suction nozzle having an outer periphery including an exterior side;

a handle;

a suction motor for generating an airstream originating at the suction nozzle;

a filtration system fluidly connected to the suction nozzle; and a vertical axis rotary agitator arrangement attached to the exterior side of the outer periphery of said suction nozzle.

9. The floor care appliance of claim 8, wherein said vertical axis rotary agitator arrangement is rotated by a member of the group consisting of a traction wheel, turbine, motor, gear drive from a rotary power source and belt drive from a rotary power source.

10. The floor care appliance of claim 8, wherein said vertical axis rotary agitator arrangement is pivotally attached to the outer periphery of said suction nozzle, said vertical axis rotary agitator arrangement having a first position non-use position and pivoted into a second operative position when in use.

11. The floor care appliance of claim 10, wherein said traction wheel is rotatably coupled to said vertical axis rotary agitator arrangement by a belt and pulley arrangement for rotating said vertical axis rotary agitator arrangement.

12. The floor care appliance of claim 8, wherein said vertical axis rotary agitator arrangement is removably attached to the outer periphery of said suction nozzle.

13. The floor care appliance of claim 12, wherein said vertical axis rotary agitator arrangement includes a mounting member for attaching said vertical axis rotary agitator arrangement to the outer periphery of said suction nozzle.

14. The floor care appliance of claim 13, wherein said mounting member includes a latch member for securing said vertical axis rotary agitator arrangement to the outer periphery of said suction nozzle.

15. The floor care appliance of claim 14, wherein said latch member is biased into a locked position when said vertical axis rotary agitator arrangement is mounted to the outer periphery of said suction nozzle.

16. The floor care appliance of claim 8, wherein said vertical axis rotary agitator arrangement includes a main body member having at least one agitator member attached thereon.

17. The floor care appliance of claim 16, wherein said at least one agitator member is a member of the group consisting of bristles, lambs wool, felt, feathers and fluff pad.

18. A floor care appliance, comprised of:

a suction nozzle having an outer periphery including an exterior side;

a handle;

a suction motor for generating an airstream originating at the suction nozzle;

a filtration system fluidly connected to the suction nozzle; and a rotary agitator arrangement attached to the exterior side of the outer periphery of said suction nozzle;

wherein said rotary agitator arrangement includes a traction wheel for rotating rotary agitator arrangement and said traction wheel is rotated by engaging a wall surface adjacent a floor edge to be cleaned when said floor care appliance is moved past said wall surface.

19. The floor care appliance of claim 18, further including a suction port formed in the outer periphery of the suction nozzle on right and left edges of said suction nozzle.

20. The floor care appliance of claim 19, further including a gate biased in a closed position installed in each of said suction ports formed in the outer periphery of the suction nozzle on the right and left edges of said suction nozzle.

21. The floor care appliance of claim 20, wherein said rotary agitator arrangement further includes a mounting member having a gate opening member which opens said gate when said rotary agitator arrangement is installed on said suction nozzle.

22. The floor care appliance of claim 18, further including a suction port formed in the outer periphery of the suction nozzle on a front edge on right and left hand sides of said suction nozzle.

23. The floor care appliance of claim 22, further including a gate biased in a closed position installed in each of said suction ports formed in the outer periphery of the suction nozzle on the front edge on the right and left hand sides of said suction nozzle.

24. The floor care appliance of claim 23, wherein said rotary agitator arrangement further includes a mounting member having a gate opening member which opens said gate when said rotary agitator arrangement is installed on said suction nozzle.

25. The floor care appliance of claim 18, wherein said rotary agitator arrangement is rotated by a member of the group consisting of a traction wheel, turbine, motor, gear drive from a rotary power source and belt drive from a rotary power source.

26. The floor care appliance of claim 18, wherein said rotary agitator arrangement is coupled to a rotary power source by a transmission arrangement selected from a member of the group consisting of planetary gears, belt and pulleys, toothed gears, and helical and worm gears.

27. A method of edge cleaning, comprised of the steps of:

providing a floor care appliance having a suction nozzle having an outer periphery, a suction motor, a handle, and a particle collecting and filtration arrangement;

placing a rotary agitator powered by a traction wheel on the outer periphery of the suction nozzle;

placing the traction wheel in operative engagement with a wall surface adjoining an edge to be cleaned;

moving the suction nozzle over a floor surface such that the traction wheel is rotated by engaging the wall surface and particles along the wall edge are swept into the path of the suction nozzle; and removing the swept particles by moving the suction nozzle over the particles.

* * * * *